US005769680A

United States Patent [19]

Hoffman

[11] Patent Number: 5,769,680

[45] Date of Patent: Jun. 23, 1998

[54] DRINKING VESSEL WITH AN INTERNALLY FORMED DISPLAY CHAMBER

[76] Inventor: Edward J. Hoffman, 2/F, Flat A, 21 Sampan St., Wanchai, Hong Kong

[21] Appl. No.: 758,008

[22] Filed: Nov. 27, 1996

Related U.S. Application Data

[63] Continuation-in-part of Ser. No. 570,600, Dec. 11, 1995, abandoned.

[51] Int. Cl.[6] ..... A63H 33/00; B65D 1/04

[52] U.S. Cl. ..... 446/75; 446/74; 215/6; 206/217

[58] Field of Search ..... 446/72–74, 75, 446/77; 206/518, 217; 220/504, 296–298; 215/6

[56] References Cited

U.S. PATENT DOCUMENTS

| | | | |
|---|---|---|---|
| 2,636,597 | 4/1953 | Hinz | 446/73 X |
| 2,792,696 | 5/1957 | Stayart | 446/76 X |
| 3,136,447 | 6/1964 | Lawrence | 220/298 |
| 4,232,502 | 11/1980 | Lucas | 53/453 |
| 5,419,436 | 5/1995 | Powell | 206/519 |
| 5,487,486 | 1/1996 | Menco | 220/504 |

*Primary Examiner*—Mickey Yu

[57] ABSTRACT

The present invention provides a drinking vessel including an internally formed display area for concealing a decorative element such as a three dimensional figurine. The internally formed display area upwardly extends into a fluid retention cavity of the drinking vessel. A retaining member is provided which can be selectively removed to access the decorative element. In the preferred embodiment, the retaining member is rotatable relative to an upwardly extending sidewall of the drinking vessel to thereby lock the retaining member in place. In one application, the retaining member includes a plurality of radially extending tabs which cooperate with a inwardly extending cylindrical flange formed to include a corresponding plurality of notches. The tabs are upwardly advanced past the notches and then rotated to thereby lock the retaining member in place.

9 Claims, 4 Drawing Sheets

DRINKING VESSEL WITH AN INTERNALLY FORMED DISPLAY CHAMBER

CROSS-REFERENCE TO RELATED APPLICATION

This is a continuation-in-part application of U.S. Ser. No. 08/570,600 filed Dec. 12, 1995 abandoned.

BACKGROUND OF THE INVENTION

1. Field of the Invention

The present invention relates in general to the art of containers, such as but not limited to, drinking vessels. More particularly, the present invention relates to cups or other beverage containers including a chamber for displaying a decorative element such as a three-dimensional figurine. In one application, the present invention includes a rotatably engageable retaining member for retaining the decorative element within the chamber.

2. Discussion

Drinking cups and glasses for children have been previously provided with various decorative features. For example, such decorative features have included depictions of cartoon characters on the surface of the glass, or illustrations of a character on the bottom of the glass. The provision of decorations on the surface of the cup or glass tends to provide visual stimulation for a child as the child handles the cup or glass, but is not readily visible as a beverage is being consumed from the top of the glass and does not serve to encourage the child to drink the beverage. The provision of the depiction of a character on the bottom of a cup or glass provides a view when a colored or otherwise opaque beverage has been consumed, but not during drinking of the beverage. For clear beverages, the depiction of the character on the bottom of the cup or glass is somewhat visible, but significantly impaired by the presence of the moving liquid contained in the glass, until the liquid has been substantially consumed.

Additionally, children's cups have included caps having cartoon characters illustrated thereon. In these types of arrangements, the character is visible substantially all the time and the child is not encouraged to consume any of the beverage in the cup to observe the illustrated decorative character.

Applicant has identified the following U.S. patent references as pertinent to the subject invention: U.S. Pat. Nos. 4,232,502 to Lucas; 5,419,436 to Powell; and 5,487,486 to Menco. These references teach a container having a segregated compartment. U.S. Pat. No. 4,232,502 discloses a drinking cup and container for a beverage concentrate which is made by shaping a piece of thin plastic film on a shaped form by a vacuum to form a shaped lining including one or more compartments. The invention described therein is particularly applicable to disposable cups wherein a beverage concentrate or the like, such as an instant coffee product, is packaged by a closure. U.S. Pat. No. 5,419,436 discloses a cup with an article receiving area on the bottom surface. In the preferred embodiment, the article receiving area is covered by a film. Other embodiments disclose an article receiving area which includes a cap (see FIG. 8). None of the embodiments discloses a rotatably engagable retaining member. U.S. Pat. No. 5,487,486 discloses a beverage container including a beverage compartment and an ice compartment in heat exchange contact with the beverage compartment.

SUMMARY OF THE INVENTION

The present invention comprises an improvement over known beverage containers which include an article receiving area, including those discussed in the aforementioned patents. More particular, the present invention provides a new and improved drinking vessel which includes a retaining member for securely and selectively retaining a decorative element within an internally formed display area for viewing.

In a first preferred embodiment, the present invention provides a drinking vessel for selectively retaining a decorative element for viewing. The drinking vessel includes a generally flat bottom surface and a generally cylindrical sidewall which upwardly extends from the generally flat bottom surface. A fluid retention cavity is at least partially defined by the generally cylindrical sidewall. An internally formed display area for receiving the decorative element upwardly extends into the fluid retention cavity. The drinking vessel further includes a retaining member for selectively retaining the decorative element within the internally formed display area. The retaining member is rotatable relative to the generally cylindrical sidewall between a release position and retained position. In the release position, vertical translation of the retaining member relative to the generally cylindrical sidewall is permitted. In the retained position, such vertical translation is prevented.

Accordingly, it is an object of the present invention to provide a drinking vessel having an internal chamber containing a decorative element such as a three dimensional decorative figurine.

It is a related object of the present invention to provide a drinking vessel having a three dimensional character located in an internal chamber thereof such that the character is visible from the top and sides of the drinking vessel.

It is yet another object of the present invention to provide a drinking vessel for a child that includes a internal chamber located on the bottom of the cup and having a transparent top surface for the chamber so a figure may be located within the chamber and may be viewed from above provided that the drinking vessel does not contain a colored beverage over the top of the chamber.

It is another object of the present invention to provide a drinking vessel that is pleasing in appearance and is sufficiently sturdy for handling by a child, both during drinking and when there is no beverage present.

It is still another object of the present invention to provide a drinking vessel having a display area for a decorative element and retaining member selectively engageable with the drinking vessel for retaining the decorative element within the display area.

It is also an object of the present invention to provide a drinking vessel having a removable base having figures or other decorative elements attached, thereby allowing for changing the base attached to the drinking vessel for purposes of changing the figure included within the display area.

BRIEF DESCRIPTION OF THE DRAWINGS

Additional objects and advantages of the present invention will be apparent from a reading of the following detailed description of the preferred embodiments which makes reference to the drawings of which.

DETAILED DESCRIPTION OF THE PREFERRED EMBODIMENT

Figure 1:
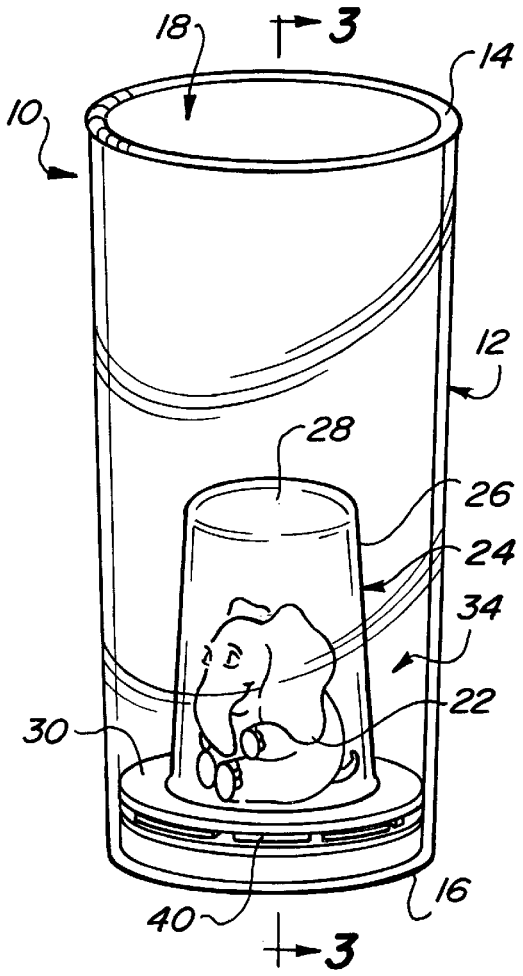
FIG. 1 is a top and front side perspective view of a drinking vessel constructed in accordance with the teachings of the first preferred embodiment of the present invention to include an internally formed display chamber.
Figure 2:
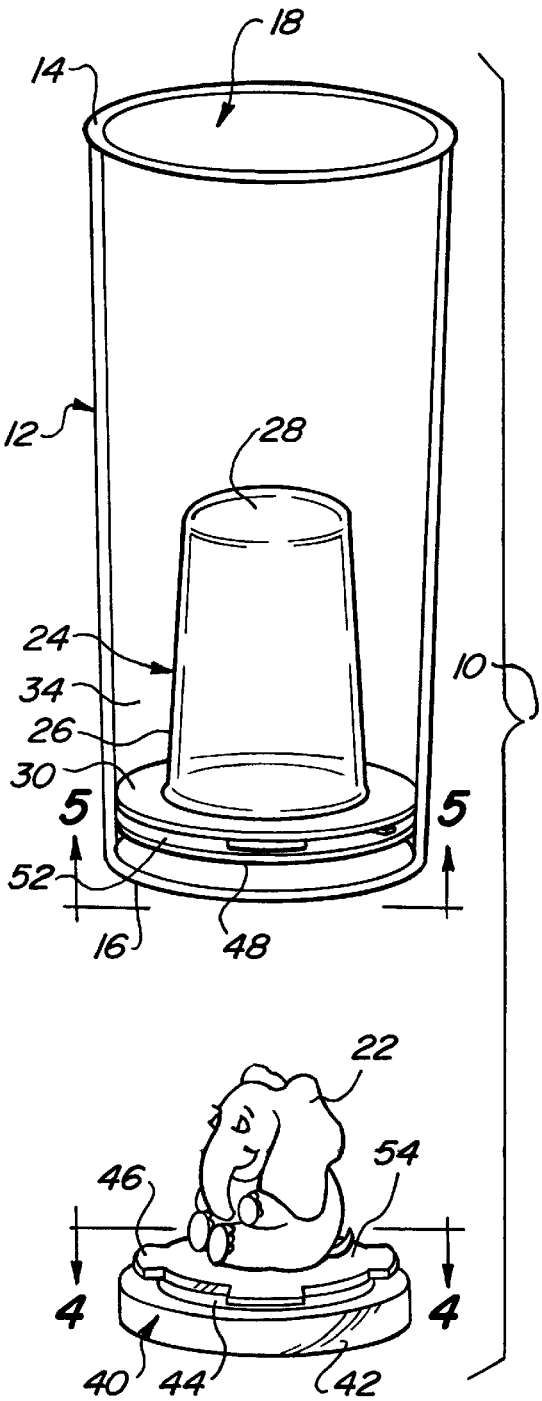
FIG. 2 is an exploded view of the drinking vessel of FIG. 1, it will be understood that the upwardly extending sidewall and internal chamber of the drinking vessel are both cylindrical and thereby appear identical from each of a front, rear, left side and right side view.
Figure 4:
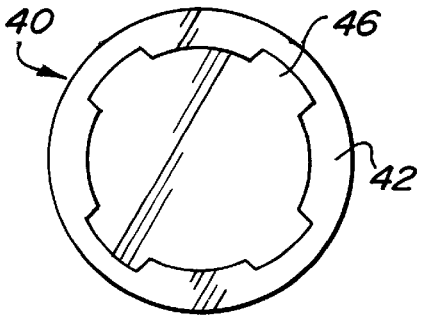
FIG. 4 is a top view of the retaining member of FIG. 1 shown in the direction of the line 4—4 of FIG. 2 and further shown detached from the decorative element for purposes of illustration.
Figure 3:
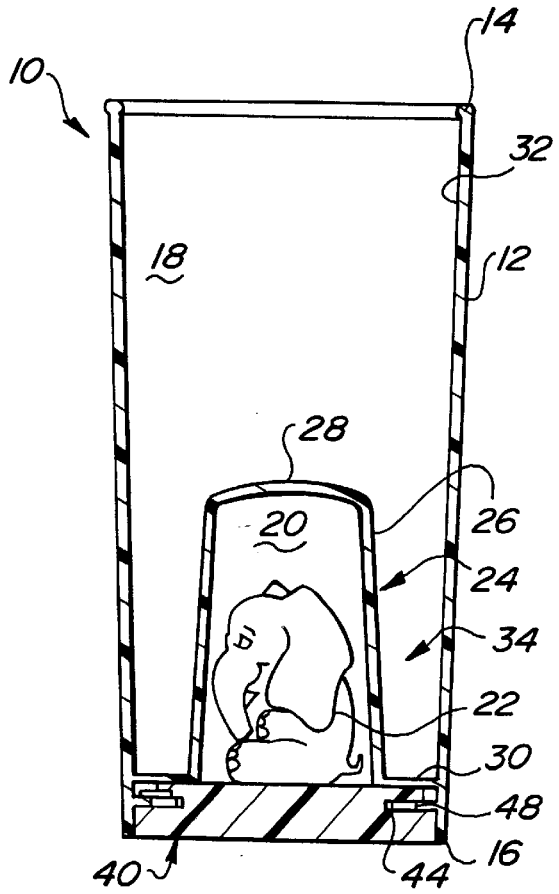
FIG. 3 is a cross-sectional view taken along the line 3—3 of FIG. 1.
Figure 5:
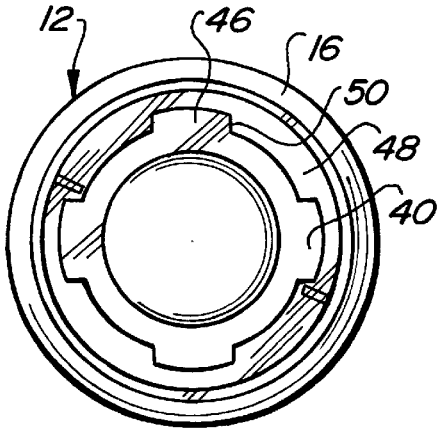
FIG. 5 is a bottom view of the drinking vessel shown taken in the direction of the line 5—5 of FIG. 2 and shown with the retaining member removed for purposes of illustration.
Figure 6:
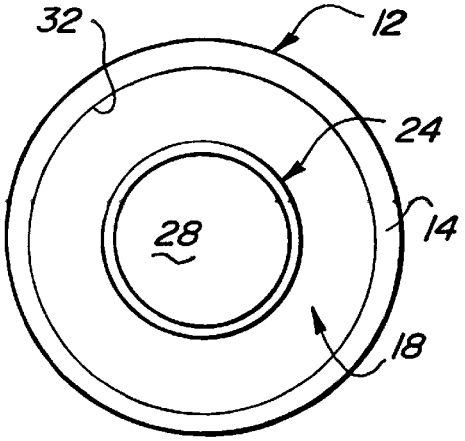
FIG. 6 is a top view of the drinking vessel of FIG. 1.
Figure 7:
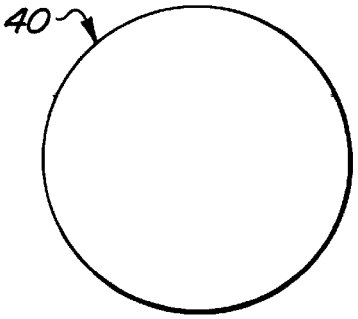
FIG. 7 is a bottom view of the retaining member of FIG. 4.

The present invention provides an improved drinking vessel for selectively retaining a figurine or other decorative object for display within an internal display area. While shown throughout the drawings, including a particular figurine, it will be appreciated by those skilled in the art that the invention is not so limited in scope. In this regard, the teachings of the present invention will be understood to be readily adapted for selectively retaining any type of figurine or other decorative article or material, within the internal display area.

Turning to the drawings in which identical or equivalent elements have been denoted with like reference numerals, and specifically to FIGS. 1–7 thereof, a first preferred embodiment of an exemplary drinking vessel constructed in accordance with the teachings of the present invention is shown. The drinking vessel is identified throughout the drawings generally with reference numeral 10.

As illustrated, the drinking vessel 10 is shown to include an upwardly extending sidewall which is continuous and generally cylindrical in geometry. The upwardly extending sidewall 12 terminates at its upper end at an upper edge, or lip 14. The upper edge 14 may be rounded for drinking convenience as well as for seating of a cover (not shown) thereon. At its lower end, the upwardly extending sidewall 12 terminates in a lower edge 16 which provides a generally flat bottom surface for supporting the drinking vessel 10. The upwardly extending sidewall 12 at least partially defines a fluid retention cavity 18.

The drinking vessel 10 further includes an internally formed display area 20 for receiving a decorative element, such as a three dimensional figurine 22. The internally formed display area 20 upwardly extends into the fluid retention cavity 18 and is partially defined by a dome 24. The dome 24 is generally frustoconical in shape, having an upwardly tapering side surface and a top surface 28. The dome 24 is interconnected to the upwardly extending sidewall 12 through a generally torridal element 30. In the preferred embodiment, the dome 24, torridal element 30 and an inner surface 32 of the upwardly extending sidewall 12 cooperate to define the fluid retention cavity 18. Further in the preferred embodiment, a gap 34 is provided between the dome 24 and the inner side 32 of the sidewall 12 such that fluid placed within the fluid retention cavity 18 surrounds the internally formed display area. If the fluid is not transparent, such as milk, filling the drinking vessel 10 above the top 28 of the dome 24 will serve to effectively occlude view of the decorative element 22.

The drinking vessel 10 further includes a retaining member 40 for selectively retaining the decorative element 22 within the internally formed display area 20. The retaining member 40 is rotatable relative to the upwardly extending sidewall 12 between a release position and a retaining position. In the exemplary embodiment illustrated, the retaining member 40 is shown to include a lower base portion 42 of generally cylindrical construction which is dimensioned to be received within the sidewall 12 adjacent its lower edge 16. The retaining member 40 also includes an upwardly extending cylindrical portion 44 of reduced diameter and a plurality of radially extending tabs 46. In the exemplary embodiment illustrated, the plurality of radially extending tabs 46 are four in number. However, it will be appreciated by those skilled in the art, that any number of radially extending tabs 46 may be incorporated.

The drinking vessel 10 further includes an inwardly extending cylindrical flange 48 interdisposed between the torridal element 30 and the lower edge 16 of the sidewall 12. As shown most clearly in the bottom view of FIG. 5, the cylindrical flange 48 is formed to include a plurality of notches 50 corresponding in number with the plurality of radially extending tabs 46. The notches 50 are arranged and sized so as to permit the radially extending tabs 46 to vertically pass as the retaining member 40 is introduced within the drinking vessel 10 (as shown in FIG. 1). In use, when the radially extending tabs 46 are upwardly passed beyond the notches 50, the retaining member 40 can then be rotated to a retained position. As such, the radially extending tabs 46 are retained within a cylindrical channel 52 defined between the torridal element 30 and the cylindrical flange 48. In the preferred embodiment, the thickness of the radially extending tabs 46 varies such that the tabs 46 become wedged within the channel 52 upon clockwise rotation of the retaining member 40. As a result, the retaining member 40 is securely held within the drinking vessel 10 but can easily be removed when desired.

In the embodiment illustrated, the figurine 22 is illustrated to be permanently attached to an upper surface 54 of the retaining member 40. This way, the figurine 22 can be removed from the drinking vessel 10 and remain supported on a base (i.e., the lower base portion 42 of the retaining member 40). It will be appreciated by those skilled in the art that the figurine 22 may alternatively be removably attached to the retaining member 40 or merely supported by the retaining member 40.

In the preferred embodiment, the sidewall 12, dome 24, torridal element 30, and flange 48 are unitarily constructed of a clear plastic or other suitable material not easily subjected to breakage. It will be understood by those skilled in the art that a threaded connection may alternatively be provided between the retaining member 40 and the remainder of the drinking vessel 10.

Figure 8:
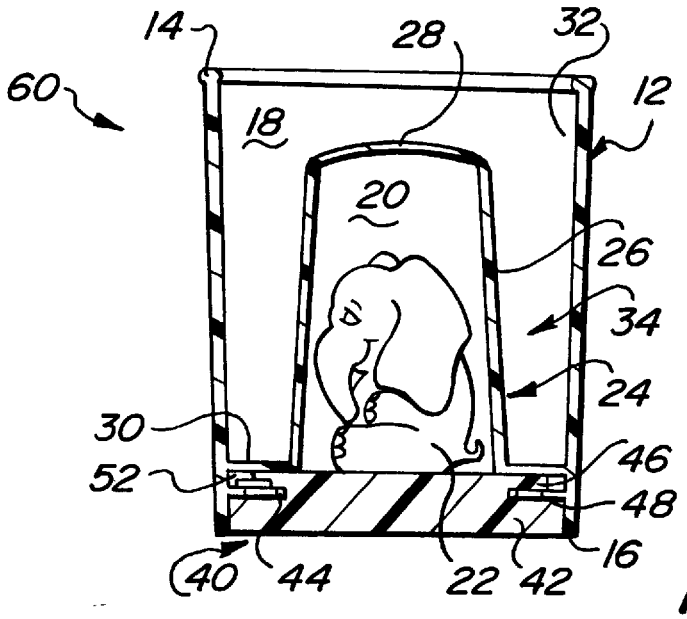
FIG. 8 is a cross-sectional view similar to FIG. 3, illustrating a second preferred embodiment constructed in accordance with the teachings of the present invention, it being understood that the second preferred embodiment is identical to the first preferred embodiment with the exception that the second preferred embodiment incorporates a relatively shorter upwardly extending sidewall.

Turning to the cross-sectional view of FIG. 8, a drinking vessel 60 constructed in accordance with the teachings of a second preferred embodiment of the present invention is illustrated. As noted above, the drinking vessel 60 is identical to the drinking vessel 10 with the exception that the sidewall 12 of the drinking vessel 60 are relatively shorter. Common reference numerals are used between the first and second preferred embodiments to designate substantially identical elements. It will be understood by those skilled in the art that the teachings of the present invention can be readily extended to sidewalls 12 having a varying dimension.

Figure 9:
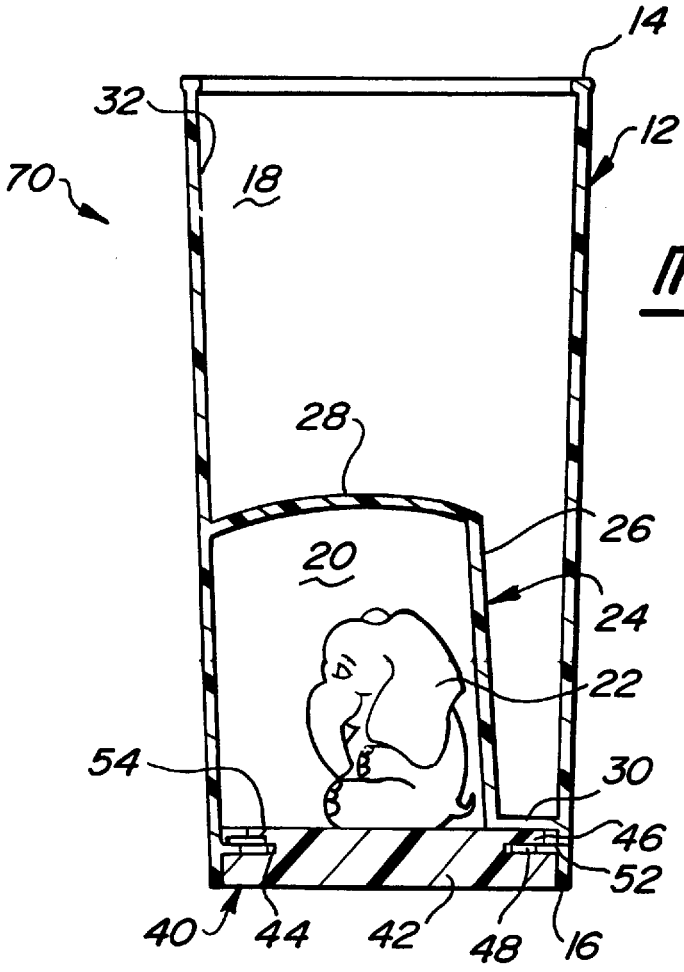
FIG. 9 is another cross-sectional view similar to FIG. 3, illustrating a drinking vessel constructed in accordance with the teachings of a third preferred embodiment of the present invention, it being understood that the third embodiment of the present invention is identical to the first preferred embodiment of the present invention with the exception that the internal cavity defined for displaying the decorative element includes a top surface which intersects the upwardly extending sidewall.

Turning now to the cross-sectional view of FIG. 9, a drinking vessel 70 constructed in accordance with a third preferred embodiment of the present invention is illustrated. As with the second preferred embodiment, elements of the third preferred embodiment common with the first preferred embodiment have been identified with common reference numerals. The drinking vessel 70 of the third preferred embodiment departs from the drinking vessel 10 of the first preferred embodiment in that the top 28 of the dome intersects the sidewall 12. In this regard, the fluid introduced into the fluid retention cavity 18 will not fully surround the internally formed display area 20. As a result, viewing of the decorative element 22 will be permitted from one side of the drinking vessel 10 even when the drinking vessel 10 is filled with an opaque liquid.

Figure 10:
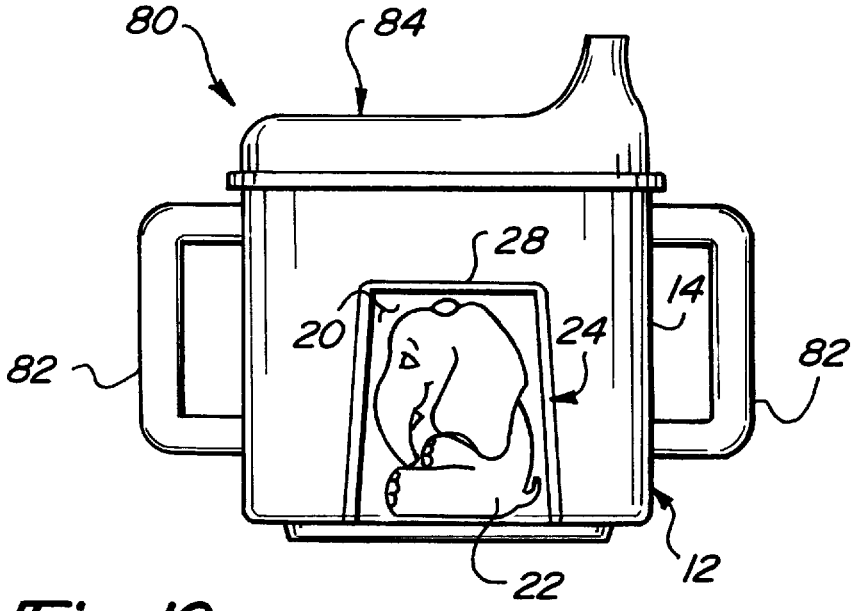
FIG. 10 is a front view illustrating a drinking vessel constructed in accordance with the teachings of a fourth preferred embodiment of the present invention.

Turning now to the front view of FIG. 10, a drinking vessel 80 constructed in accordance with a fourth preferred embodiment of the present invention is illustrated. As with the prior embodiments, elements of the fourth preferred embodiment common with the first preferred embodiment have been identified with common reference numerals. The drinking vessel 80 of the fourth preferred embodiment departs from the drinking vessel 10 of the first preferred embodiment in that it is in the form of a child sipper cup. In this regard, the sidewall 12 is relatively shorter and the vessel is integrally constructed to include a pair of handles 82. The drinking vessel also includes a sipper top 84 of generally conventional construction.

While the various preferred embodiments of the present invention have been described throughout to include a removable retaining member 40, it should be further understood that certain applications it may be desirable to fixedly attach the retaining member 40. For example, the retaining member 40 may be glued or sonically welded in place where it is desired to provide a sealed internal display area.

These and other objects of the present invention will be made available through implementation of the invention as described herein with reference to the drawings and will suggest many variations all of which are intended to be covered by this patent, as set forth in the claims appended hereto and their equivalents.

I claim:

1. A drinking vessel, the drinking vessel comprising:

a decorative element:

a generally flat bottom surface;

a first generally cylindrical sidewall upwardly extending from said generally flat bottom surface;

a fluid retention cavity at least partially defined by said first generally cylindrical sidewall; and an internally formed display area at least partially defined by a second generally cylindrical sidewall positioned within said first cylindrical sidewall, said internally formed display area operative for receiving the decorative element, said decorative element being in a desired stationary position in said display area for enhancing viewing of the decorative element, said internally formed display area upwardly extending into said fluid retention cavity;

said first and second generally cylindrical sidewalls being transparent to allow viewing of the decorative element.

2. The drinking vessel of claim 1, wherein the decorative element is attached to a retention member.

3. The drinking vessel of claim 1, further comprising a generally toroidal element interdisposed between said internally form display area and said first generally cylindrical sidewall.

4. The drinking vessel of claim 3, wherein said generally torridal element partially defines said fluid retention cavity and is spaced apart from said generally flat bottom surface.

5. The drinking vessel of claim 4, further comprising a cylindrical flange inwardly extending from said first cylindrical sidewall and disposed between said generally torridal element and said generally flat bottom surface, said cylindrical flange cooperates with a retaining member to selectively retain said retaining member.

6. The drinking vessel of claim 1 further comprising a pair of handles integrally formed on opposite sides of said first generally cylindrical sidewall.

7. The drinking vessel of claim 1 further comprising a retaining member for selectively retaining the decorative element within said internally formed display area.

8. A drinking vessel, the drinking vessel comprising:

a first generally cylindrical sidewall upwardly terminating at a tip and downwardly terminating in a flat bottom surface;

a fluid retention cavity at least partially defined by said generally cylindrical sidewall;

a decorative element;

an internally formed display area at least partially defined by a second generally cylindrical sidewall, said internally formed display area operative for receiving the decorative element, said internally formed display area upwardly extending into said fluid retention cavity;

a generally toroidal element interconnecting said first generally cylindrical sidewall and said second generally cylindrical sidewall;

a retaining member for selectively retaining the decorative element within said internally formed display area, said decorative element affixed to said retaining member for maintaining a desired position in said display area, said retaining member begin rotatable relative to said generally cylindrical sidewall between a release position permitting vertical translation of the retaining member relative to the generally cylindrical sidewall in a retained position preventing such vertical translations;

a cylindrical flange inwardly extending from said first generally cylindrical sidewall and disposed between said generally toroidal element and said flat bottom surface, said cylindrical flange configured to cooperate with said retaining member to selectively retain said retaining member; and said first and second generally cylindrical sidewalls being transparent to allow viewing of the decorative element.

9. The drinking vessel of claim 8 further comprising a pair of handles integrally formed on opposite sides of said first generally cylindrical sidewall.

* * * * *